US005522456A

United States Patent [19]

Valk

[11] Patent Number: 5,522,456

[45] Date of Patent: Jun. 4, 1996

[54] OVERFLOW WITH THREADED PLASTIC FILLNECK FOR SURGE TANKS AND OVERFLOW RESERVOIRS

[75] Inventor: Dieter Valk, Kalamazoo, Mich.

[73] Assignee: Geiger Technic, Inc., Kalamazoo, Mich.

[21] Appl. No.: 263,781

[22] Filed: Jun. 22, 1994

[51] Int. Cl.[6] ..... F28D 15/00

[52] U.S. Cl. ..... 165/104.32; 165/917; 123/41.54; 277/152; 220/DIG. 32

[58] Field of Search ..... 165/917, 104.32; 123/41.54; 220/202, 203, 205, DIG. 32; 277/152

[56] References Cited

U.S. PATENT DOCUMENTS

| | | | |
|---|---|---|---|
| 4,185,751 | 1/1980 | Moore et al. | 220/203 |
| 4,887,733 | 12/1989 | Harris | 220/203 |
| 5,248,052 | 9/1993 | Mellinger et al. | 123/41.54 |
| 5,357,909 | 10/1994 | Attinger et al. | 165/104.32 |

FOREIGN PATENT DOCUMENTS

| | | | |
|---|---|---|---|
| 0347175 | 12/1989 | European Pat. Off. | 277/152 |
| 2411306 | 7/1979 | France | 220/DIG. 32 |
| 3243374 | 5/1984 | Germany . | |
| 0189478 | 8/1991 | Japan | 277/152 |
| 2073845 | 10/1981 | United Kingdom | 277/152 |

OTHER PUBLICATIONS

Unauthored, untitled, undated photocopy submitted by applicant depicting a known prior art pressure release cap.

*Primary Examiner*—John Rivell

*Assistant Examiner*—Christopher Atkinson

*Attorney, Agent, or Firm*—Flynn, Thiel, Boutell & Tanis

[57] ABSTRACT

An overflow arrangement which includes an upstanding fluid retaining wall spaced radially outwardly from and encircling an upstanding externally threaded fillneck on a surge tank or overflow reservoir so as to define an annular channel therebetween. A cap adapted to be screwed onto and off of the upstanding threaded fillneck is provided, the cap having a generally circular-shaped top wall, a skirt depending downwardly from a radially outer periphery of the top wall and a radially outwardly extending flange contiguous with a lower extremity of the skirt to a radial extremity overlying an upwardly facing extremity of the upstanding fluid retaining wall. An elastically compressible seal is oriented between the upwardly facing extremity which becomes compressed between the upwardly facing extremity and the radially outwardly extending flange in response to a screwing of the cap onto the upstanding threaded fillneck, the radially outwardly extending flange moving toward the upwardly facing extremity in response to a screwing of the cap onto the threaded fillneck and away from the upwardly facing extremity in response to an unscrewing of the cap from the threaded fillneck. A drain connection is provided leading to a location remote from the tank or reservoir for facilitating a removal of fluid connected in the annular channel therefrom.

2 Claims, 1 Drawing Sheet

OVERFLOW WITH THREADED PLASTIC FILLNECK FOR SURGE TANKS AND OVERFLOW RESERVOIRS

FIELD OF THE INVENTION

This invention relates to an overflow arrangement for use with an upstanding threaded fillneck provided on a surge tank or an overflow reservoir for use with an automotive cooling system.

BACKGROUND OF THE INVENTION

As with present designs of a threaded fillneck on top of a pressurized radiator surge tank, an overpressurization of the fluid above the standard pressure rating causes the automotive coolant fluid (glycol) to spew, upon activation of the standard pressure relief valve in the closure member, over the outside surface of the reservoir and possibly onto the engine. High temperature automotive coolant could cause a fire once it contacts a hot part of the engine. It could also cause a short circuit in the automobile electrical circuits which, in turn, could cause a fire.

Accordingly, it is an object of the invention to provide a fluid retaining wall around the threaded fillneck in order to collect the flui spewing out of the reservoir into an annular channel and guiding it to a drain outlet; and a location remote from the fillneck.

It is a further object of the invention to provide an overflow arrangement, as aforesaid, wherein a seal is provided between the closure member and the upwardly facing extremity of the fluid-retaining wall.

It is a further object of the invention to provide a fluid retaining wall, as aforesaid, having a flange seal for facilitating a sealed relationship between a closure member and an upwardly facing extremity of the fluid retaining wall so as to retain hot automotive coolant within the confines defined by the fluid retaining wall and to prevent direct contact of the coolant with a hot engine.

It is a further object of the invention to provide an overflow arrangement, as aforesaid, wherein a drain connection is provided in the annular channel defined between the threaded fillneck and the fluid retaining wall for facilitating a removal of any fluid contained in the annular channel.

SUMMARY OF THE INVENTION

In general, the objects and purposes of the invention are met by providing an overflow arrangement which includes an upstanding fluid retaining wall spaced radially outwardly from and encircling an upstanding externally threaded fillneck on a surge tank or overflow reservoir so as to define an annular channel therebetween. A cap adapted to be screwed onto and off of the upstanding threaded fillneck is provided, the cap having a generally circular-shaped top wall, a skirt depending downwardly from a radially outer periphery of the top wall and a radially outwardly extending flange contiguous with a lower extremity of the skirt to a radial extremity overlying an upwardly facing extremity of the upstanding fluid retaining wall. An elastically compressible seal is oriented between the upwardly facing extremity which becomes compressed between the upwardly facing extremity and the radially outwardly extending flange in response to a screwing of the cap onto the upstanding threaded fillneck, the radially outwardly extending flange moving toward the upwardly facing extremity in response to a screwing of the cap onto the threaded fillneck and away from the upwardly facing extremity in response to an unscrewing of the cap from the threaded fillneck. A drain connection is provided leading to a location remote from the tank or reservoir and hot parts of the automotive engine for facilitating a removal of fluid contained in the annular channel.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DESCRIPTION

Figure 1:
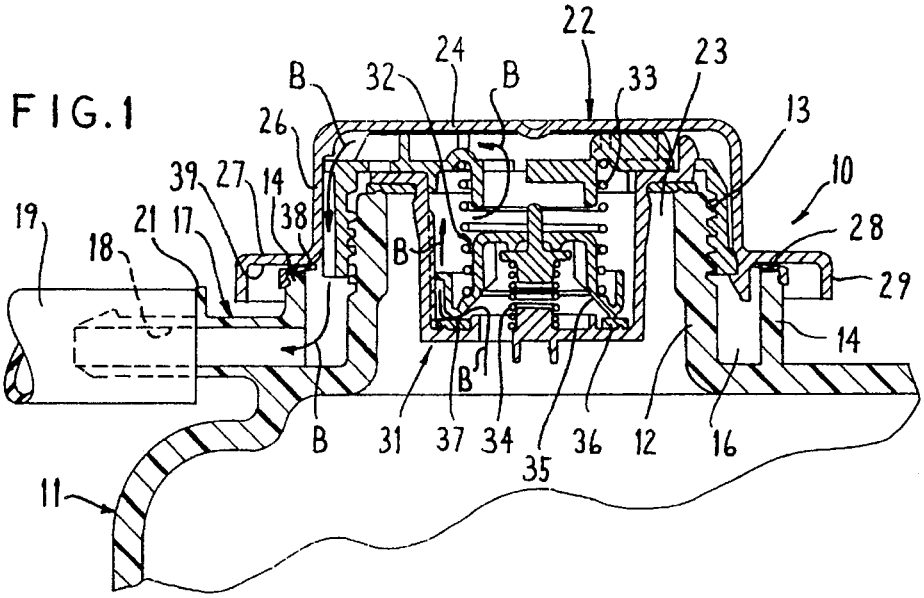
FIG. 1 is a central sectional view through an overflow arrangement embodying the invention.

An overflow arrangement 10 embodying the invention is illustrated in the drawing. The overflow arrangement is provided in an automotive cooling system wherein a surge tank or overflow reservoir 11 is provided. The surge tank or overflow reservoir can be of any configuration but it is also to have an upstanding fillneck 12 with an external thread 3 provided thereon. In addition, an upstanding, annular fluid retaining wall is also provided on the surge-tank or overflow reservoir. Since the surge tank and overflow reservoir are usually made of a moldable synthetic resin material, it will be apparent to those skilled in this art that the surge tank and overflow reservoir described hereinabove can be a molded product. It will be noted that the upstanding fluid retaining wall 14 is spaced radially outwardly from the fillneck 12 so as to define an annular channel 16 therebetween.

A drain connection 17 is provided on the surge tank or overflow reservoir 11 and, in this particular embodiment, the overflow drain connection includes a passageway 18 that extends through the connection as well as through the retaining wall 14. A flexible hose 19 or the like is coupled to the free end of the drain connection 17 with the remote end of the hose being located at a remote location such as a location along side of or below the level of the automotive engine. In this particular embodiment, the internal diameter of the passageway through the hose 19 is just slightly smaller than the outside diameter of the drain connection 17 so that the holes will be frictionally held onto the drain connection 17. If desired, a stop 21 can be provided so as to limit the extent that the hose 19 can slide onto the free end of the drain connection 17.

A closure member or cap 22 is provided for closing the upwardly facing opening 23 into the fillneck 12. In this particular embodiment, the closure member or cap 22 includes a circular shaped top wall 24 and a skirt 26 depending downwardly from a radially outer periphery of the top wall 24 and a radially outwardly extending flange 27 contiguous with a lower extremity of the skirt 26. The radially outermost extremity of the radially outwardly extending flange 27 overlies an upwardly facing extremity 28 of the fluid retaining wall 14. If desired, a further skirt 29 can be povided and which downwardly depends from the radially outermost extremity of the radially outwardly extending flange 27 radially outside of the fluid retaining wall 14.

The closure member 22 also includes a fluid pressure relief mechanism 31 for facilitating a relief of fluid pressure that may build up in the surge tank or overflow reservoir 11 when the closure member 22 is tightly screwed onto the fillneck 12. The fluid pressure relief valve mechanism 31 is of a conventional variety and, as a result, further detailed discussion concerning the construction of it is believed unnecessary. That is, it is believed that one of ordinary skill in the art would understand that a pressure valve 32 forming a part of the valve mechanism 31 is balanced between a pair of coiled springs 33 and 34 so that the pressure valve 32 will be lifted away from a seal 36 in response to the fluid pressure reaching a predesignated pounds per square inch level on the surface 35. Once the designated pressure level is exceeded, a lip 37 on the pressure valve 32 is lifted away from the seal 37 against the urging of the spring 33 so as to cause fluid to pass through the closure member 22 in direction of the arrows B into the annular channel 16 and thence out through the passageway 18 of the drain connection 17. Usually the fluid in the surge tank or overflow reservoir 11 is extremely hot and the provision of the annular fluid retaining wall 14 prevents this fluid from coming in contact with a hot automobile engine. Since the fluid used for cooling the engine has a low flash point, the provision of the fluid retaining wall 14 prevents the fluid from contacting the engine and possibly starting a fire.

The provision of the downwardly depending skirts 26 and 29 as well as the radially outwardly extending flange 27 prevents the hot fluid from spewing out of the opening 23 of the fillneck 12 and coming into contact with the hands of an operator engaging the closure member 22.

Figure 2:
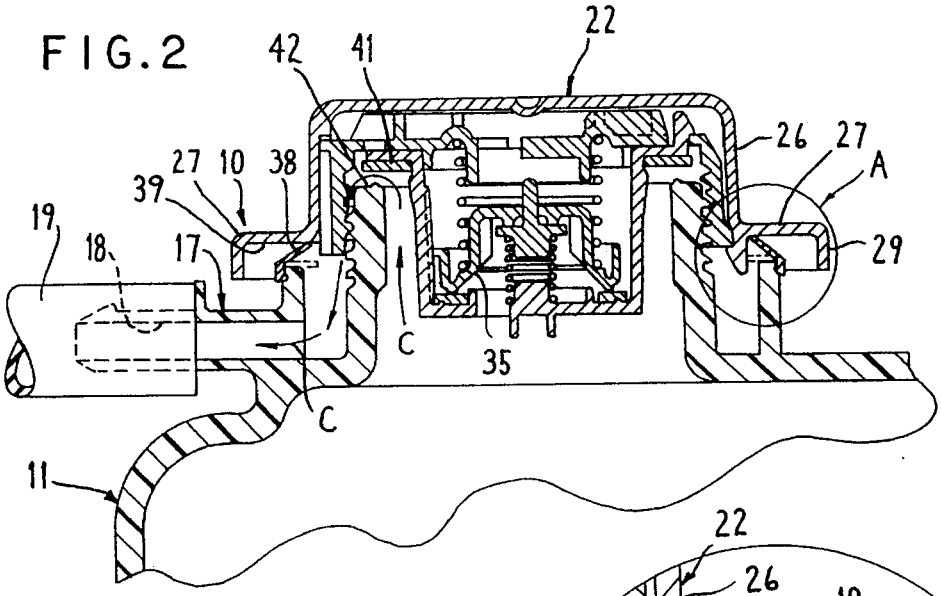
FIG. 2 is a central sectional view similar to FIG. 1 but with the closure cap being loosened somewhat on the threaded fillneck for the surge tank or overflow reservoir.
Figure 3:
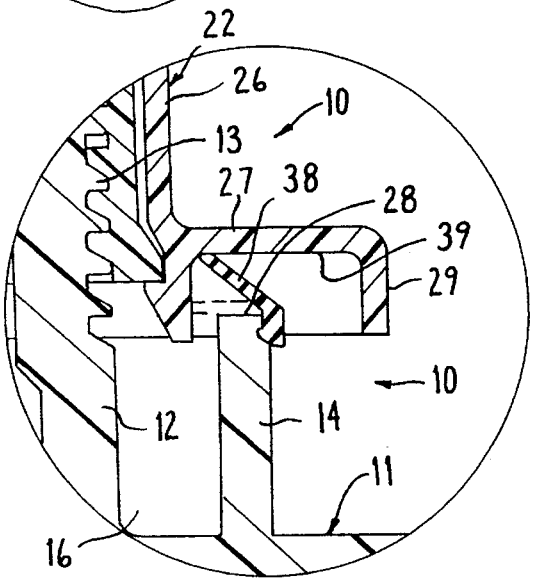
FIG. 3 is an enlarged fragment of the encircled portion A illustrated in FIG. 2.

An elastically expandable seal 38 is provided between the upwardly facing extremity 28 of the fluid retaining wall 14 and a downwardly facing surface 39 of the radially outwardly extending flange 27 so as to provide a sealed relationship therebetween. As the closure member 22 is unscrewed from the threaded fillneck 12 to a position illustrated in FIG. 2, it will be noted that the flange 38 remains in contact with the downwardly facing surface 39 of the radially outwardly extending flange 27. The ability of the seal 38 to expand from the broken line position illustrated in FIGS. 2 and 3 to the solid line position illustrated in FIGS. 2 and 3 prevents hot fluid from spewing past the seal and possible coming into contact with the hot automobile engine or the hands of an operator adjacent the closure member 22. Once the surface on an inside surface of the closure member 22 is lifted away from an upwardly facing extremity 42 of the externally threaded fillneck 12, hot fluid will be able to flow in the direction of the arrows C between the threaded portion between the closure member 22 and the threads 13 on the fillneck 12 into the annular channel 16 and thence out through the passageway 18 of the drain connection 17. Usually, and before the closure member 22 can be completely unthreaded from the fillneck 12, the fluid having a tendency to escape will cease by reason of a release of the fluid pressure so that the closure member 22 can be removad to fully expose the opening 23 into the fillneck 12.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An overflow arrangement for use with an upstanding threaded fillneck provided on a surge tank or an overflow reservoir of an automotive cooling system, comprising:

an upstanding fluid retaining wall spaced radially outwardly from and encircling the upstanding threaded fillneck so as to define an annular channel therebetween;

a cap adapted to be screwed onto and off of the upstanding threaded fillnecK, said cap having a generally circular-shaped top wall, a skirt depending downwardly from a radially outer periphery of said top wall and a radially outwardly extending flange contiguous with a lower extremity of said skirt to a radial extremity overlying an upwardly facing extremity of said upstanding fluid retaining wall;

flange seal having an annular base part encirclingly sealingly engaged with an upper extremity of said upstanding fluid retaining wall and a normally upstanding annular flap part hingably connected to said base part and being moved about the hinge connection from an upright first condition to a flattened econd condition as said cap is screwed onto the upstanding threaded fillneck to form a sealed relationship between said radially outwardly extending flange and said upwardly facing extremity, and awa from said upwardly facing extremity in response to an unscrewing of said cap from the upstanding threaded fillneck, said seal expanding to a last condition as said unscrewinq occurs but remaining in a sealed relation with said upwardly facing extremity and said radially outwardly extending flange so as to prevent an escape of fluid past said seal until said cap. has been substantially unscrewed from the upstanding threaded fillneck any fluid tending to boil out of the tank or reservoir being permitted to pass a clearance between said cap and upstanding threaded fillneck and into said annular channel; and a drain connection leading to a location remote from the tank or reservoir for facilitating a removal of fluid collected in said annular channel therefrom.

2. An overflow arrangement for use with an upstanding threaded fillneck provided on a surge tank or an overflow reservoir of an automotive cooling system, comprising:

an upstanding fluid retaining wall spaced radially from the upstanding threaded fillneck so as to define an annular channel therebetween;

a cap having an extremity adapted to be manually engaged to facilitate said cap being screwed onto and off of the upstanding threaded fillneck, said cap having a means thereon defining a flange overlying an upwardl facing extremity of said upstanding fluid retaining wall;

a flange seal having an annular base part encirclingly sealingly engaged with an upper extremity of said upstanding fluid retaining wall and a normally upstanding annular flap part hingably connected to said base part and being moved about the hinge connection from an upright first condition to a flattened second condition as said cap is screwed onto said upstanding threaded fillneck to form a sealed relationship between said radially outwardly extending flange and said upwardly facing extremity, and away from said upwardly facing extremity in response to an unscrewing of said cap from the upstanding threaded fillneck, said seal expanding to a last condition as said unscrewing occurs but remaining in a sealed relation with said upwardly facing extremity and said radially outwardly extending flange so as to prevent an escape of fluid past said seal until said cap has been substantially unscrewed from the upstanding threaded fill, neck, any fluid tending to boil out of the tank or reservibeing permitted to pass a clearance between said cap and upstanding threaded fillneck and into said annular channel; and a drain connection means leading to a location remote from the tank or reservoir for facilitating a removal of fluid collected in said annular channel therefrom; and means for retarding a flow of escaping fluid to said extremity of saida so as to assure said escaping fluid will exit the tank or reservoir via said annular channel and said drain connection mans.

* * * * *

UNITED STATES PATENT AND TRADEMARK OFFICE

CERTIFICATE OF CORRECTION

PATENT NO. : 5 522 456
DATED : June 4, 1996
INVENTOR(S) : Dieter VALK

It is certified that error appears in the above-indentified patent and that said Letters Patent is hereby corrected as shown below:

Column 4, line 8; change "fillnecK" to ---fillneck---.
line 15; change "flange seal" to ---a flange seal---.
line 20; change "econd" to ---second---.
line 24; change "awa" to ---away---.
line 27; change "unscrewinq" to ---unscrewing---.
line 30; change "cap." to ---cap---.
line 32; change "fillneck any" to ---fillneck, any---.
line 49; change "upwardl" to ---upwardly---.
Column 5, line 1; change "fill,neck," to ---fillneck,---.
line 2; change "reservibeing" to ---reservoir being---.
Column 6, line 2; change "saida" to ---said cap---.
line 4; change "mans" to ---means---.

Signed and Sealed this

Third Day of December, 1996

Bruce Lehman

*Attest:*

BRUCE LEHMAN

*Attesting Officer*

*Commissioner of Patents and Trademarks*